US012313347B2

(12) United States Patent
Ruffino et al.

(10) Patent No.: US 12,313,347 B2
(45) Date of Patent: May 27, 2025

(54) LOCALLY EMBEDDED PHASE CHANGE MATERIAL FOR HEAT SINKS

(71) Applicant: L3Harris Technologies, Inc., Melbourne, FL (US)

(72) Inventors: Robert Ruffino, Richardson, TX (US); Matthew Spitzner, Lowry Crossing, TX (US); Gregory Gorski, Highlands Ranch, CO (US)

(73) Assignee: L3Harris Technologies, Inc., Melbourne, FL (US)

( * ) Notice: Subject to any disclaimer, the term of this patent is extended or adjusted under 35 U.S.C. 154(b) by 214 days.

(21) Appl. No.: 18/107,096

(22) Filed: Feb. 8, 2023

(65) Prior Publication Data

US 2024/0263890 A1 Aug. 8, 2024

(51) Int. Cl.
*F28D 17/00* (2006.01)
*F28D 20/02* (2006.01)

(52) U.S. Cl.
CPC ..... *F28D 20/02* (2013.01)

(58) Field of Classification Search
CPC ..... F28D 20/02
USPC ..... 165/10
See application file for complete search history.

(56) References Cited

U.S. PATENT DOCUMENTS

| | | | |
|---|---|---|---|
| 6,104,611 | A | 8/2000 | Glover et al. |
| 6,665,186 | B1 | 12/2003 | Calmidi et al. |
| 6,848,500 | B1 | 2/2005 | Langari et al. |
| 9,019,704 | B2 | 4/2015 | Rubenstein et al. |
| 10,043,732 | B1 | 8/2018 | Al Omari et al. |
| 10,151,542 | B2 | 12/2018 | Wood |
| 10,262,920 | B1 | 4/2019 | Refai-Ahmed et al. |
| 10,679,923 | B1 * | 6/2020 | Joshi ..... F28D 20/023 |
| 10,748,837 | B2 | 8/2020 | Kedem |
| 2002/0033247 | A1 | 3/2002 | Neuschutz et al. |
| 2011/0156245 | A1 | 6/2011 | Wu et al. |

FOREIGN PATENT DOCUMENTS

WO 2004/109798 A1 12/2004

* cited by examiner

*Primary Examiner* — Davis D Hwu
(74) *Attorney, Agent, or Firm* — Edell, Shapiro & Finnan, LLC

(57) ABSTRACT

A PCM heat sink comprises a thermally conductive body member having a plurality of PCM-receiving bores defined therein from at last one surface thereof. A plurality of pre-cast PCM rods are disposed in respective bores have a phase change temperature from solid to liquid at or just below a specified maximum operating temperature. A plurality of sealing members is disposed in respective bores to seal the rods in the bores. The sealing members may be plugs or thin disc-like lids that are brazed, welded or otherwise secured to the body member at the bore openings.

12 Claims, 9 Drawing Sheets

LOCALLY EMBEDDED PHASE CHANGE MATERIAL FOR HEAT SINKS

TECHNICAL FIELD

The present disclosure relates to improvements in embedding phase change material (PCM) in heat sinks.

BACKGROUND

Electronic systems, particularly integrated circuit (IC) devices, are known to sometimes generate a substantial amount of heat, which can adversely affect IC device reliability and functionality. Various embodiments of heat sinks have been implemented to remove heat from active areas of IC devices, most notably, for present purposes, embodiments employing phase change material (PCM). The PCM removes heat from a device by changing phase from a solid to a liquid at its phase change temperature. During a phase change the PCM absorbs heat without a corresponding increase in temperature. By absorbing heat at the point where the maximum desired operational temperature of the managed components would be reached, the temperature that is actually reached can be reduced.

Two important parameters of PCM for heat sink applications are its phase change temperature and the quantity of PCM used. By having the phase change temperature of the material near the specified maximum operational temperature of a protected device, the melting of the PCM occurs just prior to the maximum permissible operational temperature being reached. By providing a suitable quantity of PCM, such that, under normal operating conditions, the PCM remains part liquid and part solid, the temperature of the protected devices can effectively be clamped at the melting temperature.

A few of the many examples of prior art heat sinks employing phase change material are disclosed in U.S. Pat. No. 6,848,500 (Langari et al), US2011/0156245 (Wu et al), U.S. Pat. No. 10,151,542 (Wood), U.S. Pat. No. 10,748,837 (Kedem) and U.S. Pat. No. 10,262,920 (Rafai-Ahmed et al), the entire disclosures in which are incorporated herein by reference. As disclosed in these documents, PCM heat sinks are typically provided with a sealed cavity that serves as an internal reservoir for the phase change material.

As size requirements for the packaging of electronic components become smaller, the size of heat sinks used with those components must likewise become smaller. However, reductions in the size of the electronic components do not necessarily result in a reduction of the heat they generate, thereby requiring increased thermal capacitance for smaller heat sinks. To illustrate, and referring to the schematic illustration in FIGS. 1*a* and 1*b*, for a given heat load, the two heat sink size parameters that are typically considered for possible enlargement when increasing thermal capacitance are the axial dimension (i.e., thickness or length L) and the transverse dimension (i.e., width or diameter d). As a practical matter, with physical system constraints typically limiting diameter/area, the only available dimension change option is to increase axial length. However, prior art PCM manufacturing techniques do not adapt well, if at all, to increasing heat sink length to accommodate increased heat load, not to mention the limitations that increased heat sink length place on the overall size of integrated circuit packaging.

More specifically, to create a reservoir cavity for the PCM with prior art manufacturing techniques, the thermally conductive heatsink body must typically be split transversely into two halves so that an interior cavity can be created between them and filled with the phase change material. The two halves are then sealed together so that the created cavity serves as a reservoir for the PCM. This approach becomes substantially unviable from a manufacturing standpoint when heat sinks, in order to accommodate required system functions not necessarily associated with thermal management, are configured with significant complexity including many through holes, deep recesses, and irregular and complex features.

It is an object of the present invention to increase the thermal capacity of PCM heat sinks without increasing the outer dimensions thereof.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

The embodiments disclosed herein focus primarily on maximizing thermal capacitance of PCM heat sinks while minimizing heat sink length. Stated otherwise, disclosed herein are heat sink configurations, and methods of their manufacture, that enable maximizing the volume and effectiveness of PCM that can be contained in the heat sink.

Broadly stated, disclosed herein is a PCM heat sink for use in thermally managing components of a system having a maximum permissible operating temperature that is significantly higher than ambient temperature, wherein the heat sink comprises; a thermally conductive body member having mutually perpendicular axial and transverse dimensions and a plurality of PCM-receiving bores defined therein from at last one surface thereof; a plurality of pre-cast PCM rods disposed in respective bores, wherein the rods are in solid phase at ambient temperature and have a phase change temperature from solid to liquid at or just below the maximum permissible operating temperature; and a plurality of sealing members disposed in respective bores to seal the rods in the bores. The sealing members may be plugs or thin disc-like lids that are brazed, welded or otherwise secured to the body member at the bore openings.

In one example embodiment, a heat sink body member, with a short axial length relative to its transverse diameter, is formed with an array of multiple axially extending through-holes to accommodate functional requirements unrelated to thermal management. It would be extremely challenging and costly to manufacture such a heat sink configuration with a conventional reservoir for the PCM. Instead, in accordance with one concept disclosed herein, multiple blind holes or bores are formed in the top and/or bottom surface of the heat sink body and are configured to be filled with PCM and then sealed. Typically, the PCM is selected to have a solid phase (e.g., a rod) at ambient temperatures during manufacture and to have a phase change temperature at or just below the maximum specified operating temperature of the system components to be thermally managed. Sealing of the PCM in the bores may be effected with respective plugs (e.g., Lee Plugs R), or lids that may be welded or brazed in place as covers at the open ends of the bores. We have found that the resulting heat sink assembly has a significantly increased thermal capacitance without requiring increasing the axial length or transverse dimension of the heat sink. Moreover, the increased thermal capacity is achieved without requiring expensive advanced manufacturing processes.

In another example embodiment, where the heat sink configuration itself has axial and/or transverse irregularities, deep transversely extending bores may be formed at axially thick locations along the peripheral surface of the heat sink. These bores may be filled with PCM rods and sealed, as noted, with plugs or lids.

In another aspect, the use of relatively thin brazed or welded lids to cover PCM receiving cavities provides significant flexibility in designing shapes and locations of PCM reservoir cavities in a heat sink body member.

BRIEF DESCRIPTION OF THE DRAWINGS

By way of example, specific illustrative embodiments of the present disclosure will now be described with reference to the accompanying drawings.

DETAILED DESCRIPTION OF EXAMPLE EMBODIMENTS

Figure 1A:
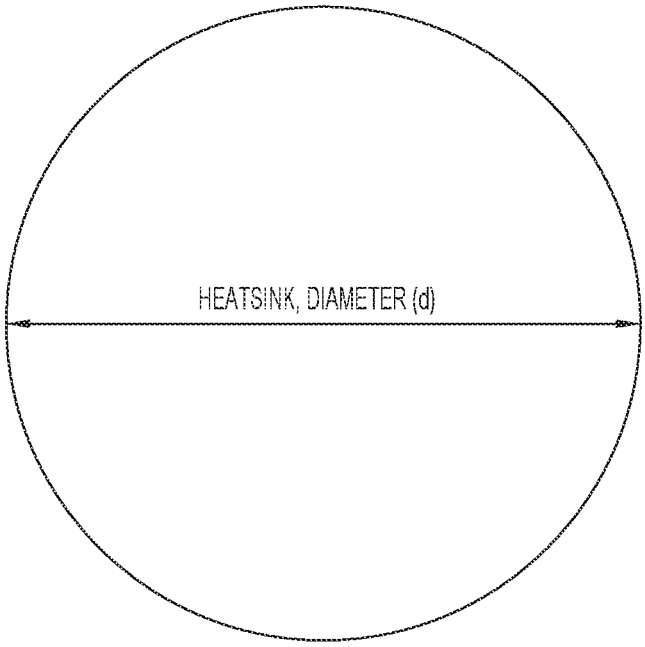
FIGS. 1*a* and 1*b* are diagrammatic illustrations of a heat sink body and are provided for purposes of illustrating transverse and axial heat sink dimensions as described herein.
Figure 1B:
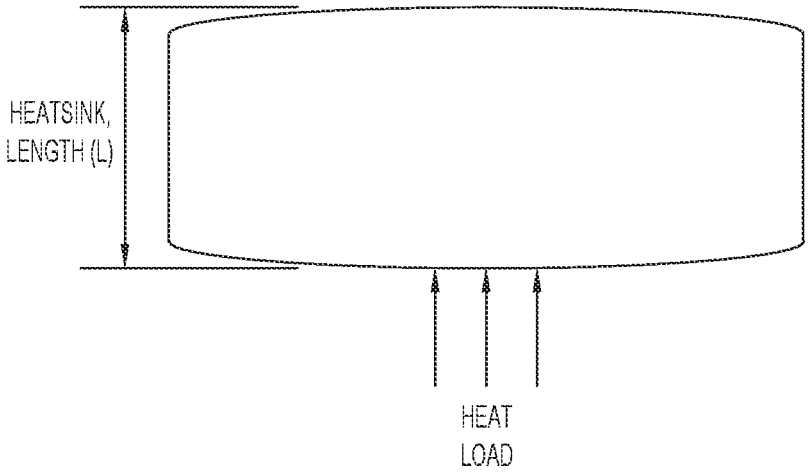

The present system and methods are described more fully hereinafter with reference to the accompanying drawings, in which several exemplary embodiments are shown. It will be readily understood that the components of the embodiments as generally described herein and illustrated in the appended drawings may be arranged and designed in a wide variety of different configurations. Thus, the following more detailed description of various embodiments, as represented in the drawings, is not intended to limit the scope of the present disclosure but is merely representative of various embodiments. While the various aspects of the embodiments are presented in the drawings, the drawings are not necessarily drawn to scale unless specifically indicated.

The subject matter disclosed herein may be embodied in other specific forms without departing from its spirit or essential characteristics; that is, the described embodiments are to be considered in all respects only as illustrative and not restrictive. The scope of the invention(s) is/are, therefore, indicated by the appended claims rather than by this detailed description. All changes that come within the meaning and range of equivalency of the claims are to be embraced within their scope.

Reference throughout this specification to features, advantages, or similar language does not imply that all of the features and advantages that may be realized with the disclosed apparatus, system and method should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the disclosed systems may be combined in any suitable manner in one or more embodiments. One skilled in the relevant art will recognize, in light of the description herein, that the embodiments can be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

The relative terms "top", "bottom", "upper', "lower" "above", "below", "forward", "rear", "height", "length", "width", "thickness", and the like as used herein are for ease of reference in the description to merely describe points of reference and are not intended to limit any particular orientation or configuration of the described subject matter.

Figure 2:
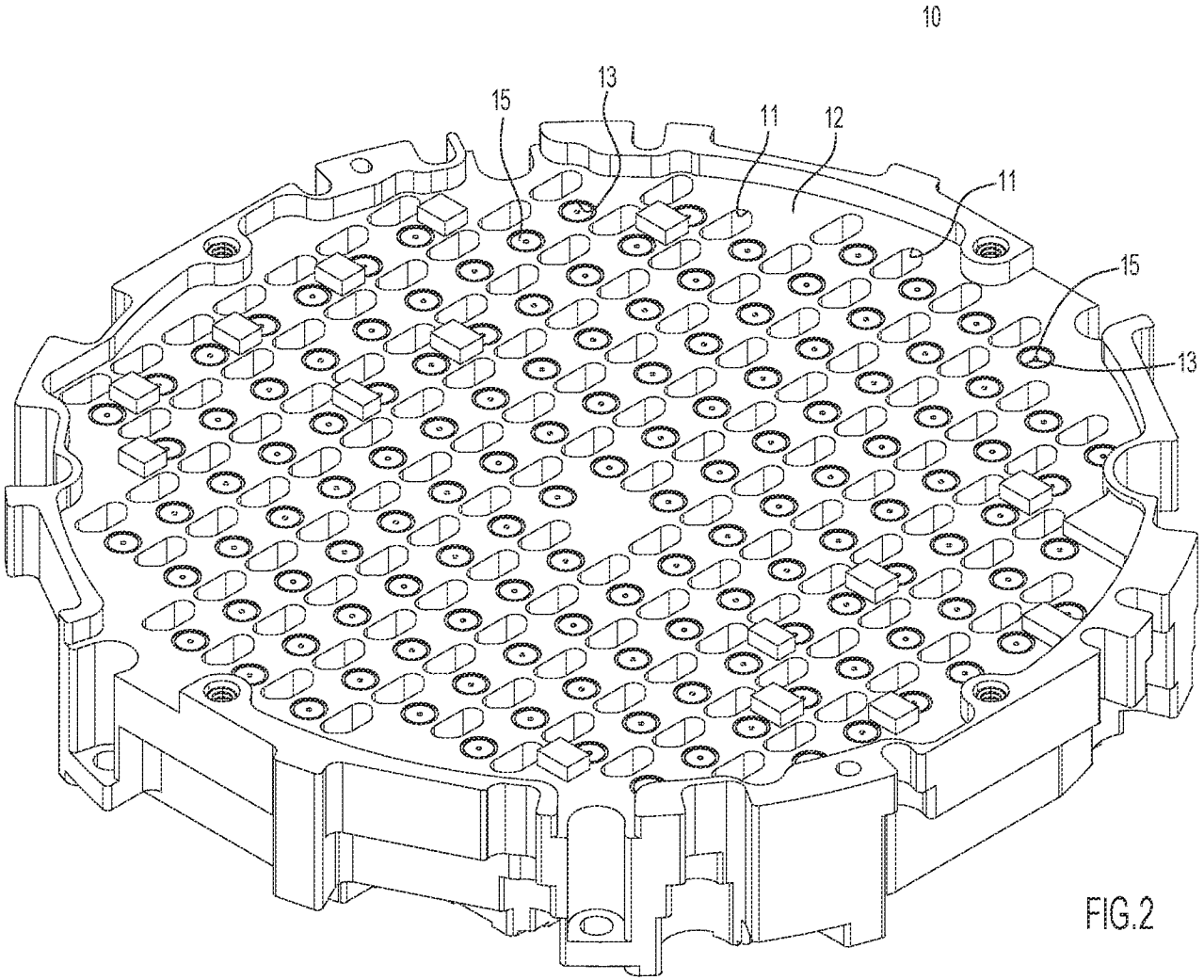
FIG. 2 is a perspective view of one embodiment of a PCM heat sink configured according to principles disclosed herein.
Figure 3:
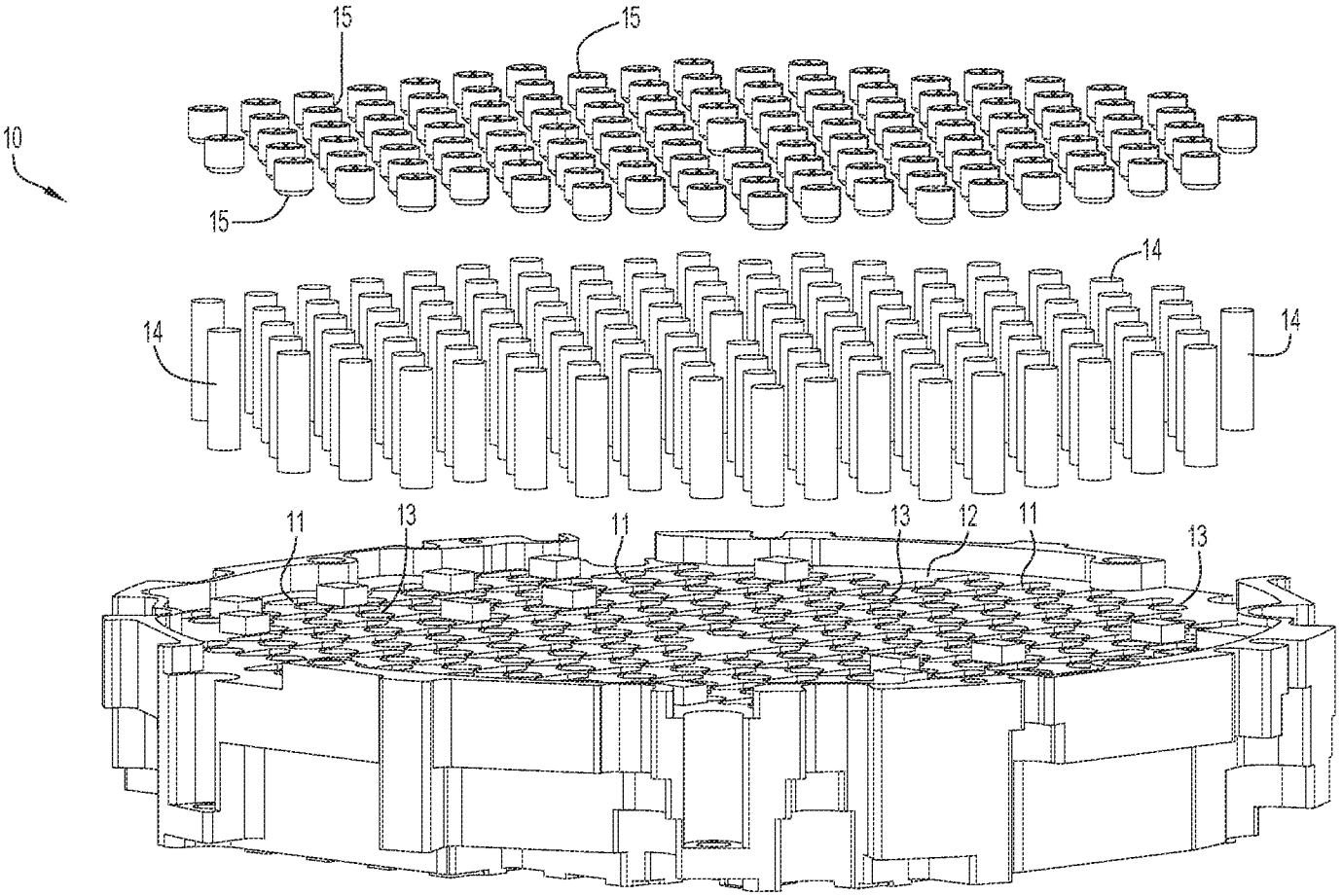
FIG. 3 is an exploded perspective view of the embodiment of FIG. 2.

Referring specifically to FIGS. 2 and 3, a heat sink 10 comprises a thermally conductive body member having a top surface 12 and a bottom surface (not shown). In one example the body member 10 is made of copper or aluminum material and has a generally short cylindrical configuration with an axial length that is substantially shorter than its diameter or transverse dimension. For purposes not necessarily relevant to its thermal management function, the heat sink may be provided with an array of axially extending through-holes 11 that serve, for example, as passageways for interconnections between a device (not shown) to be thermally protected by the heat sink and other system components. In FIGS. 2 and 3 through-holes 11 are shown as having an oval or elliptical transverse cross-section but may have any shape. The through-hole array may comprise multiple columns and rows of through-holes 11, as shown, or may be arranged in any regular or irregular pattern(s).

Multiple local PCM-receiving pockets (i.e., deep blind holes or bores) 13 are defined in top surface 12, typically by simple machining but possibly by any metal forming technique. The number, depth and transverse dimension of the bores 13 are typically determined by the desired thermal capacitance to be achieved by PCM located in the bores. In this regard, the PCM received in the bores is in the form of pre-cast rods 14 that are in solid phase at ambient temperature (i.e., when the heat sink is assembled) and have a phase change temperature from solid to liquid that is typically at or just below the maximum specified operating temperature of the system components to be thermally managed or protected by the heat sink. The PCM chosen may be any phase change material having a melting point suitable to achieve this function. For example, various forms of INDALLOY®, (e.g., INDALLOY® 51, INDALLOY® 60, et al), manufactured by Indium Corporation of America of Utica, N.Y., are available with respective phase change temperatures that will serve the purposes described.

The PCM is sealed in bores 13 at surface 12 with respective plugs 15, for example, Lee Plugs®, manufactured and sold by The Lee Company of Westbrook, Connecticut and described, for example, in U.S. Pat. No. 5,160,225 (Lee), the entire disclosure of which is incorporated herein by reference. When surface 12 is disposed proximate or adjacent the managed heat load, the locally embedded PCM rods significantly increase heatsink performance (thermal capacitance) without adding heatsink length. Moreover, the enhanced thermal capacitance is achieved with a low-cost manufacturing process.

Figure 4:
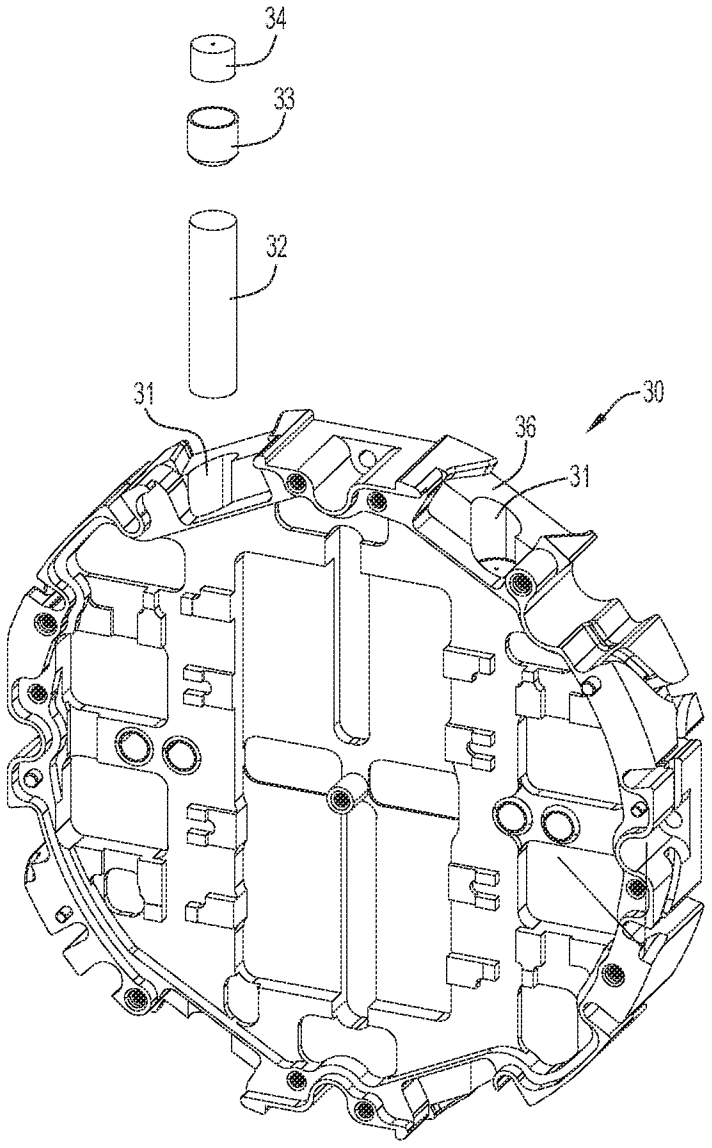
FIG. 4 is an exploded perspective view of another PCM heat sink embodiment configured according to principles disclosed herein.
Figure 5:
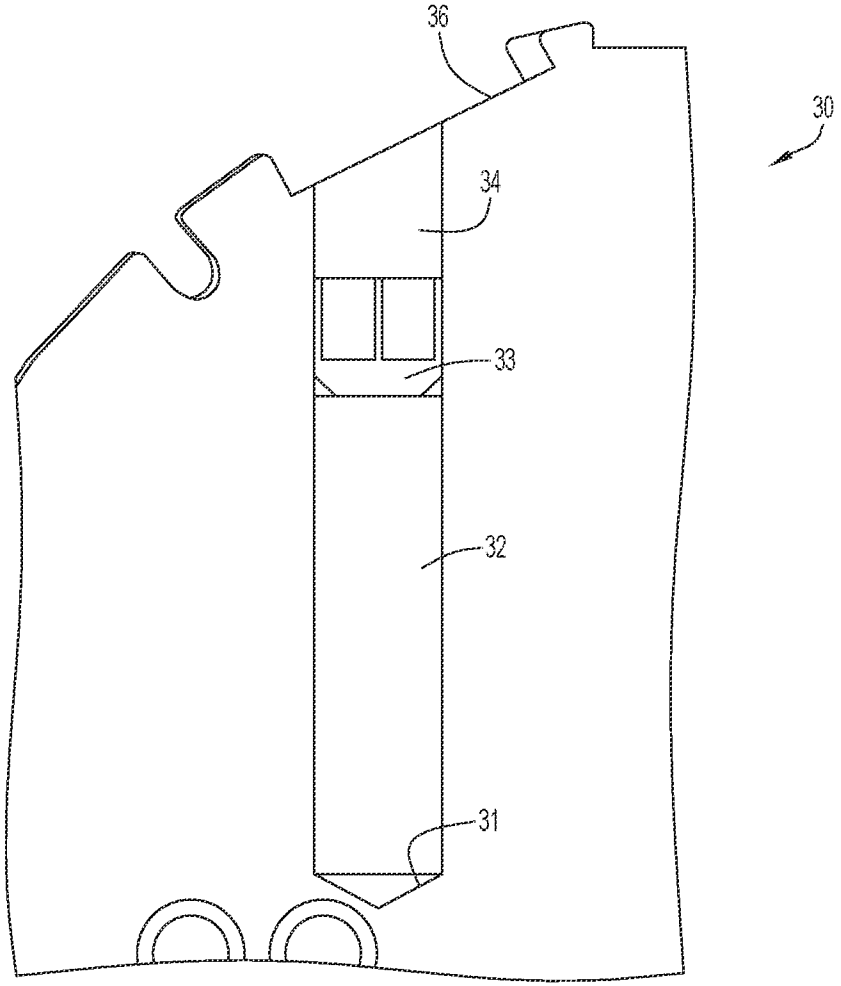
FIG. 5 is a detailed cutaway sectional view of a portion of the embodiment of FIG. 4.

Referring to FIGS. 4 and 5, a heat sink body member 30 is shown having a complex cross-sectional configuration with through-holes, variations in thickness, etc., that, like the embodiment of FIGS. 2 and 3, also defies inexpensive conventional PCM reservoir manufacturing techniques. Because of its lack of substantial depth in many locations, body member 30 is not susceptible to the formation of axially oriented PCM-receiving bores of the type provided in the embodiment of FIGS. 2 and 3. However, deep blind bores 31 are readily machined or otherwise provided in a radial or transverse direction from the sidewall 36 of the body member through the thicker sections near the heat generation. The bores may be sealed with plugs 33 and capped with lids 34 as desired.

Figure 6:
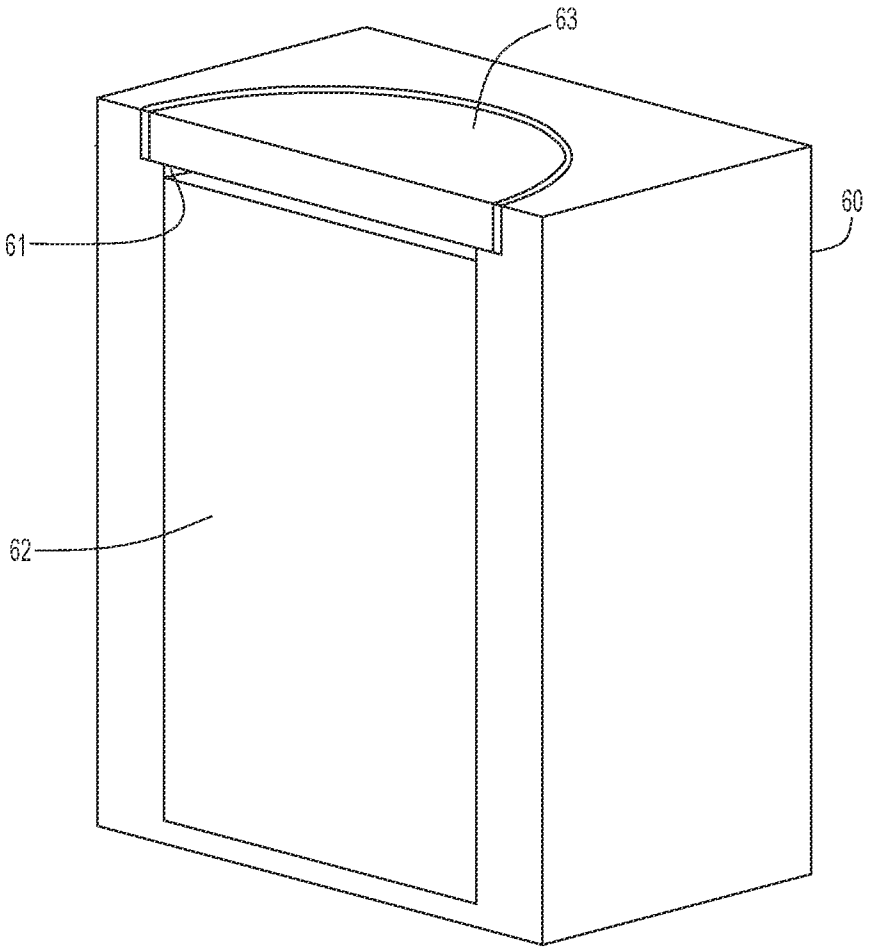
FIG. 6 is a diagrammatic perspective view in vertical section showing another PCM heat sink embodiment configured according to principles disclosed herein.
Figure 7:
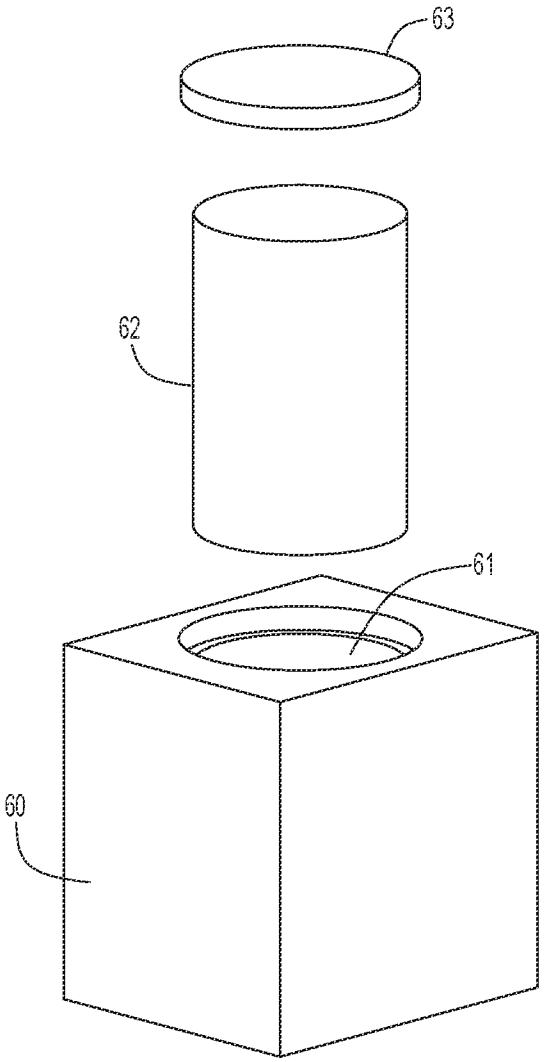
FIG. 7 is an exploded view in perspective of the embodiment of FIG. 6.

FIGS. 6 and 7 diagrammatically illustrate the use of a lid, rather than a plug, to seal the PCM receiving bores. A body member 60 is shown having a bore 61 defined therein and a PCM rod 62 contained in the bore. A thin disc-like lid 63 seals the PCM in the bore at the exposed top surface of body member 60. Use of the thinner disc seal instead of a plug increases the bore volume available for the phase change material.

Figure 8:
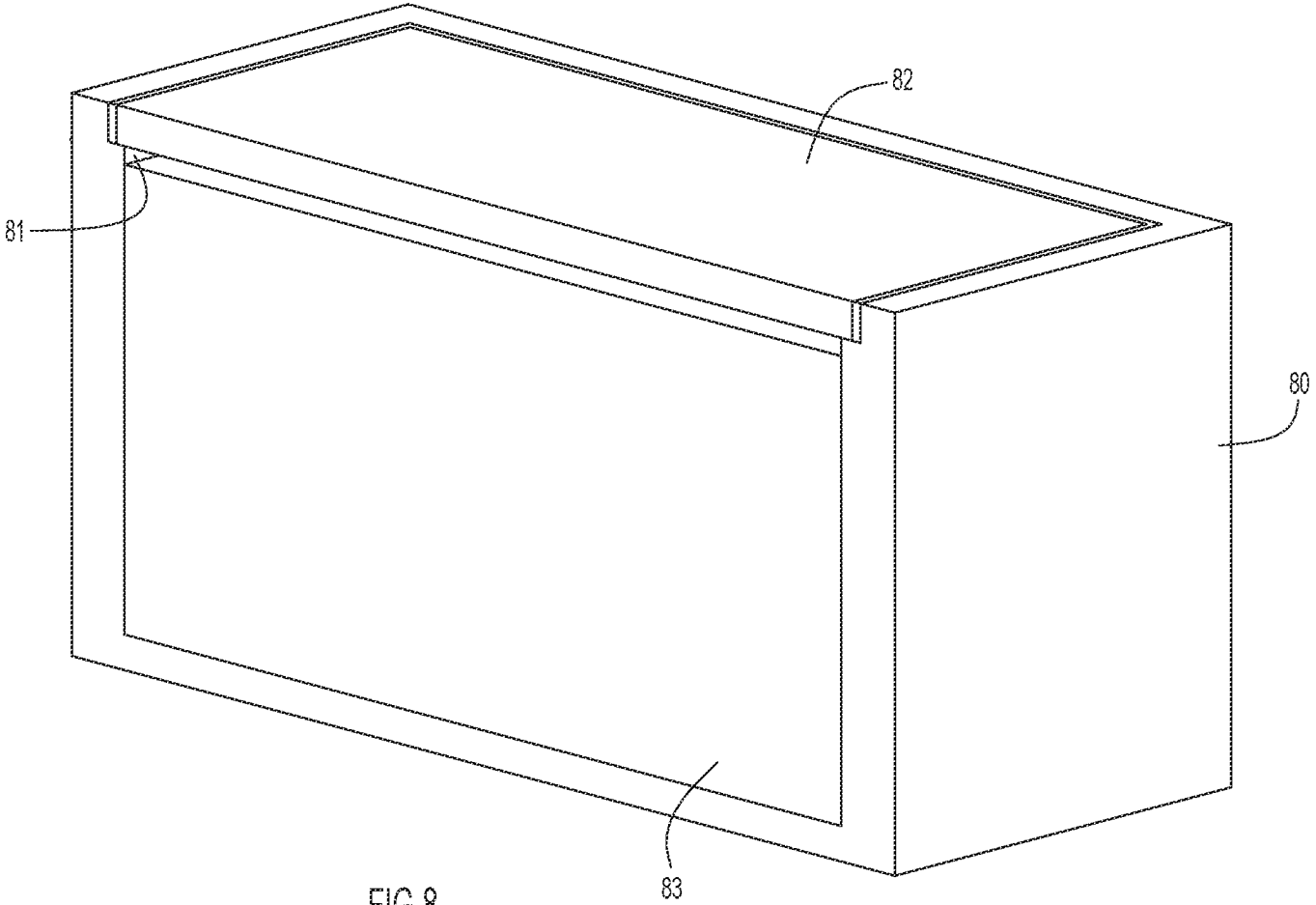
FIG. 8 is a is a diagrammatic perspective view in vertical section showing yet another PCM heat sink embodiment configured according to principles disclosed herein.
Figure 9:
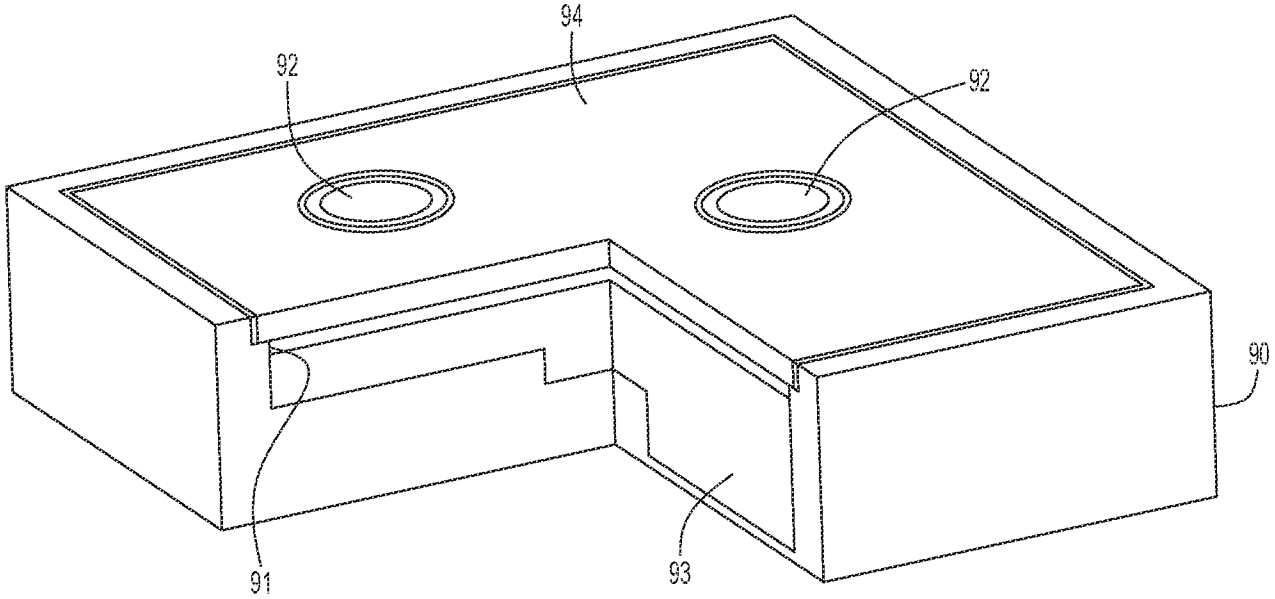
FIG. 9 is a is a diagrammatic perspective view in section showing still another PCM heat sink embodiment configured according to principles disclosed herein.

The same volume maximization approach can be used for any conventional or unconventional PCM reservoir configuration as illustrated diagrammatically in FIGS. 8 and 9. FIG. 8 depicts a heat sink body member 80 in vertical cross-section with an internal reservoir 81 containing PCM 83. The open upper end of the body member is covered by a metal lid 82 that is brazed or welded to the body member 80. The PCM may be placed in the reservoir as a pour or pre-cast block, depending on the function of the heat sink and the phase of the PCM when the heat sink is manufactures.

Reservoir 81 in FIG. 8 is shown as having a rectangular parallelepiped configuration. However, other less regular reservoir configurations may be employed as illustrated in FIG. 9 wherein heat sink body member 90 is shown as having a reservoir 91 with sections of different shapes and depths and a metal cover plate 94 that may be welded or brazed to the open upper end of the body member. The reservoir is shown filled with PCM 93 which may be placed in the reservoir in pre-cast solid form through the open end of the body member 90 before cover plate 94 is secured in place. Alternatively, the PCM may be poured into the reservoir via one or more cover plate openings that are sealed by respective lids 92 after the pour. Using a welded or brazed lid or cover provides significant flexibility for the locations and shapes of reservoirs that can be utilized. As described, pre-cast PCM shapes or simple liquid pours can fill these shapes prior to lid attachment.

As noted above, in prior art PCM heat sinks, increased thermal capacity is typically obtained by increasing the size of the internal cavity or reservoir. Such cavities are typically created by advanced manufacturing procedures, such as a vacuum braze process, which are expensive and involve difficulty in properly filling the heatsink with PCM. The present solution avoids these problems simply and inexpensively without advanced manufacturing processes. In addition, and importantly, with the present solution, PCM can be easily introduced in localized areas of the heat sink that, when the heat sink is in use, are located proximate the heat load being managed by the heat sink, thereby significantly increasing heat sink efficiency and overall performance without increasing the heat sink dimensions.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

What is claimed is:

1. A PCM heat sink for use in thermally managing components of a system having a maximum permissible operating temperature significantly higher than ambient temperature, said heat sink comprising;

a thermally conductive body member having mutually perpendicular axial and transverse dimensions and a plurality of PCM-receiving bores defined therein from at least one surface thereof;

a plurality of PCM rods disposed in respective ones of said bores, wherein said rods are in solid phase at ambient temperature and have a phase change temperature from solid to liquid at or just below said maximum permissible operating temperature; and a plurality of sealing members disposed in respective ones of said bores to seal said rods in said bores at said one surface;

wherein body member has multiple through-holes defined axially therethrough, and wherein said bores are interspersed between and extend parallel to said through-holes.

2. The PCM heat sink of claim 1 wherein said sealing members are plugs inserted into said bores at said one surface.

3. The PCM heat sink of claim 1 wherein the sealing members are thin lids that are brazed or welded to said body member at open ends of said bores at said one surface.

4. The PCM heat sink of claim 1 wherein at least some of said bores extend axially into said body member.

5. The PCM heat sink of claim 1 wherein at least some of said bores extend transversely into said body member.

6. The PCB heat sink of claim 1 wherein said sealing members are plugs.

7. A PCM heat sink for use in thermally managing components of a system having a maximum permissible operating temperature significantly higher than ambient temperature, said heat sink comprising;

a thermally conductive body member having mutually perpendicular axial and transverse dimensions and a plurality of PCM-receiving bores defined therein from at least one surface thereof;

a plurality of PCM rods disposed in respective ones of said bores, wherein said rods are in solid phase at ambient temperature and have a phase change temperature from solid to liquid at or just below said maximum permissible operating temperature; and a plurality of sealing members disposed in respective ones of said bores to seal said rods in said bores at said one surface;

wherein body member has multiple through-holes defined axially therethrough in a transverse array, and wherein said bores are interspersed between and extend parallel to said through-holes in a similarly configured array.

8. A method for providing a PCM heat sink for use in thermally managing components of a system having a maximum permissible operating temperature significantly higher than ambient temperature, said method comprising;

providing a thermally conductive body member having mutually perpendicular axial and transverse dimensions and at least one exposed surface;

forming a plurality of PCM-receiving bores in said body member from said at least one surface;

disposing a plurality of PCM rods in respective ones of said bores, wherein said rods are in solid phase at ambient temperature and have a phase change temperature from solid to liquid at or just below said maximum permissible operating temperature; and sealing said rods in said bores at said one surface;

wherein said body member has multiple through-holes defined axially therethrough, and wherein forming said bores comprises machining said bores into said body member from said one surface at locations interspersed between said through-holes.

9. The method of claim 8 wherein sealing said rods in said bores comprises inserting plugs in said bores at said one surface.

10. The method of claim 8 wherein sealing said rods in said bores comprises brazing or welding disc-like lids to said body member at open ends of said bores at said one surface.

11. The method of claim 8 wherein forming said bores comprises machining bores axially into said body member from said one surface.

12. The method of claim 8 wherein forming said bores comprises machining bores transversely into said body member from the body member periphery.

* * * * *